US005272840A

United States Patent [19]

Knoedler et al.

[11] Patent Number: 5,272,840

[45] Date of Patent: Dec. 28, 1993

[54] SECURITY GATE WITH WALK THROUGH FEATURE

[75] Inventors: Roy E. Knoedler, Boulder; T. Brent Freese, Westminster; Robert M. Parker, Aurora; Joseph E. Janicke, Eldorado Springs, all of Colo.

[73] Assignee: Gerry Baby Products Company, Denver, Colo.

[21] Appl. No.: 851,220

[22] Filed: Mar. 13, 1992

Related U.S. Application Data

[63] Continuation-in-part of Ser. No. 754,608, Sep. 4, 1991, abandoned.

[51] Int. Cl.[5] ..... E06B 3/32

[52] U.S. Cl. ..... 49/463; 49/55; 160/228

[58] Field of Search ..... 49/50, 55, 57, 263, 49/272, 394, 395, 463, 465; 160/215, 216, 222-228

[56] References Cited

U.S. PATENT DOCUMENTS

| | | | |
|---|---|---|---|
| 4,492,263 | 1/1985 | Gebhard | 160/228 |
| 4,583,715 | 4/1986 | Wright | 160/225 X |
| 4,607,455 | 8/1986 | Bluem et al. | 49/55 |
| 4,611,431 | 9/1986 | Lauro | 49/55 |
| 4,628,635 | 12/1986 | Maillard | 49/55 |
| 4,685,247 | 8/1987 | Alam | 49/55 |
| 4,831,777 | 5/1989 | Johnson, Jr. | 160/228 |
| 4,846,246 | 7/1989 | Stern | 160/224 |
| 4,884,614 | 12/1989 | Spurling | 160/225 |
| 4,944,117 | 7/1990 | Gebhard et al. | 49/55 |
| 5,052,461 | 10/1991 | Stern | 160/224 |
| 5,060,421 | 10/1991 | Castelli | 49/463 |

FOREIGN PATENT DOCUMENTS

| | | | |
|---|---|---|---|
| 2357660 | 5/1975 | Fed. Rep. of Germany | 49/55 |
| 2058186 | 4/1981 | United Kingdom | 49/55 |
| 2214551 | 9/1989 | United Kingdom | 49/55 |
| 2234283 | 1/1991 | United Kingdom | 49/55 |

OTHER PUBLICATIONS

Century "Gateway" Instruction Sheet.

*Primary Examiner*—Peter M. Cuomo
*Assistant Examiner*—Jerry Redman
*Attorney, Agent, or Firm*—Biebel & French

[57] ABSTRACT

A gate is provided for use as a closure device within a doorway and includes an L-shaped frame member which may be positioned in stationary relationship to the doorway and a panel member which is pivotally mounted to the frame member. The panel member carries a latching mechanism including a latch for engaging a lower horizontal extension of the frame member to prevent pivotal movement of the panel portion. In addition, a contact member is provided for contacting a surface of the doorway when the latch member is engaged with the frame. A release lever is provided for moving the contact member out of engagement to allow pivotal movement of the panel relative to the frame. A locking member is provided for preventing operation of the lever such that the locking member must be operated simultaneously with the lever in order to release the contact member.

24 Claims, 10 Drawing Sheets

192
190
110
120
132
148
96
188
180
142
124
140
122
158
184
118
160
162
168
112
170
20
174

SECURITY GATE WITH WALK THROUGH FEATURE

CROSS-REFERENCE TO RELATED APPLICATION

This application is a continuation-in-part of application Ser. No. 07/754,608, filed Sep. 4, 1991 now abandoned.

BACKGROUND OF THE INVENTION

The present invention relates to a closure device for placement in a doorway and, in particular, to a gate which may be frictionally engaged within a doorway for preventing small children or pets from passing through the doorway.

In environments where small children, infants or pets are present, it is generally desirable to have a closure device or gate which may be removably placed within a doorway to prevent passage therethrough. For example, it may be desirable to restrict small children to a particular room without shutting the door to the room such that one can look into the room or the children can see an adult nearby. Alternatively, it is often desirable to have a gate which may be conveniently placed at the top of stairs where a door is not available whereby children are prevented from access to the stairs.

Various prior art gate devices have been proposed wherein the gate may be removably mounted within a doorway and which typically include means for adjusting the width of the gate to accommodate different doorway widths. For example, U.S. Pat. No. 4,492,263 to Gebhardt discloses an infant security door gate assembly which includes upper and lower support bars incorporating coil springs positioned within telescoping tubes to form a compression friction fit within the doorway. In addition, the gate is formed of a pair of complementary panels which follow the telescoping expansion and contraction of the support bars.

U.S. Pat. No. 4,944,117 to Gebhardt et al discloses another construction for a security gate including a pair of overlapping panels which may be adjusted relative to each other to provide a general width adjustment for the gate to be positioned in close proximity to the sides of the doorway. A mechanism is provided along the edge of one of the panels including a foot operated actuator for moving a pair of edge blocks outwardly from the edge of the panel to frictionally engage the side of the doorway.

While the above-described gates are satisfactory for preventing passage of a small child, infant or pet through the doorway, such gates have occasionally proved to be inconvenient when the doorway must be temporarily opened to allow passage therethrough, such as when an adult desires to pass into or out of a room for which the gate is acting as a closure device. In order to pass through the doorway, the adult must first release the mechanism attaching the gate to the doorway and pivot the gate out of the way, and subsequently reinstall the gate within the doorway, which can prove to be inconvenient and time consuming.

In a further prior art gate which attempts to address the above-described difficulties, a mounting frame is provided for the gate including two vertically extending sections for engaging opposing sides of a doorway. A pair of panels is provided between the frame sections wherein one panel is rigidly attached to the frame and a second panel is pivotally connected to the first panel and includes a release latch for engaging one of the vertical sections to maintain the gate in a closed position. Thus, the frame portion may be positioned in frictional contact with the sides of a doorway and the pivoted section may be opened and closed as needed to allow passage through the doorway.

One problem with the latter described security gate is that a toddler may easily learn how to manipulate the safety release latch to open the gate such that the gate is limited in its applications to use with infants and pets.

Accordingly, there is a need for a safety gate for use as a closure within a doorway which is easily adjustable to the doorway and which permits easy passage for an adult through the doorway.

In addition, a safety gate is needed which may be used with infants, toddlers and pets and which may be easily opened to allow passage therethrough while providing a secure locking system which cannot be actuated by a toddler.

SUMMARY OF THE INVENTION

The present invention provides a closure device for use in a doorway which is defined by opposing first and second surfaces. The closure device includes a panel portion having opposing first and second vertical sides for positioning adjacent to the first and second doorway surfaces.

A frame member is also provided including a vertical portion and a horizontal portion such that the frame member is formed as an L-shaped structure. The vertical portion extends parallel to the vertical sides of the panel and the horizontal portion extends parallel to a horizontal edge of the panel. The panel is mounted to the frame member by a hinge structure engaging the vertical portion of the frame member.

In addition, first engagement means are mounted to the vertical frame member portion for engaging the first doorway surface and a second engagement means is provided on the end of the horizontal frame member portion for engaging the second doorway surface and the second engaging means is spring biased outwardly. Thus, the first and second engagement means act to frictionally hold the frame member in a predetermined position within the doorway.

The hinge member mounts the panel portion to the frame member for pivotal movement whereby the panel portion may pivot relative to the frame member. The panel portion includes a contact member which is supported for movement with the panel portion as it pivots and which is adapted to engage the second doorway surface when the panel portion is positioned parallel to the horizontal portion of the frame member.

The contact member is spring biased outwardly for engagement with the second doorway surface and a lever is operably connected to the contact member wherein operation of the lever actuates the contact member to move inwardly into the panel portion and away from engagement with the second doorway surface. A locking member is also provided for preventing operation of the lever. The locking member is actuated by a button located on the panel such that actuation of the button causes the locking member to release the lever for movement.

In addition, a latch member is located at a lower portion of the panel for engaging the horizontal portion of the frame member when the panel is located parallel to the horizontal frame. A linkage connects the contact member to the latch member via the lever such that actuation of the contact member also causes actuation of the latch member to move the latch member out of engagement with the horizontal frame portion such that the panel will be free to pivot relative to the frame member.

In a second embodiment of the present invention, the contact member is actuated for movement into and out of the panel portion by the lever which is pivotally mounted to the panel portion. The lever is movable through an aperture in the upper surface of the panel portion such that movement of the lever upwardly causes the contact member to move into the panel portion and movement of the lever downwardly causes the contact member to move outwardly into contact with the second doorway surface.

As in the previous embodiment, a locking member is provided for preventing the lever from moving to a disengaged position. The locking member includes a pawl member which is biased into engagement with a slot formed in the lever and movement of the locking member away from the lever releases the lever for movement to disengage the contact member from the doorway surface. Latch members are also provided in this embodiment for engaging with the horizontal portion of the frame member. However, the latch members are formed integrally with the lower edge of the panel portion such that the panel portion must be moved upwardly in order to release the latch members from engagement with the frame member. In order to accommodate this movement of the panel portion, the hinge structure is formed with upper and lower hinge members defining oval apertures for receiving the vertical portion of the frame member. Thus, the panel portion may be pivoted at the hinge members whereby the lower edge of the panel portion may be angled upwardly in order to clear the latch members from the horizontal frame member portion adjacent to the second engagement means.

Finally, in the second embodiment, a lower engagement member of the first engagement means is pivotally mounted to the frame member adjacent to the junction between the vertical and horizontal portions to facilitate mounting of the frame member within the doorway. During installation of the frame member, the lower engagement member of the first engagement means may be pivoted slightly downwardly as the second engagement means is positioned in contact with the second doorway surface, and the frame member adjacent to the first engagement means may be subsequently moved downwardly to pivot the lower engagement member to a horizontal position resulting in the frame member being firmly engaged between the opposing doorway surfaces.

Therefore, it is an object of the present invention to provide a closure device for use within a doorway wherein the width of the closure device may be adjusted to accommodate different doorway sizes.

It is a further object of the present invention to provide a closure device which upon actuation of a catch and latch mechanism permits a closure panel for the device to be freely pivoted for allowing passage of an adult through the doorway.

It is also an object of the present invention to provide a doorway closure device which may be pivoted to an open position and which includes a lock mechanism for cooperation with a lever to prevent the closure from being opened by a toddler.

Other objects and advantages of the invention will be apparent from the following description, the accompanying drawings and the appended claims.

DETAILED DESCRIPTION OF THE PREFERRED EMBODIMENTS

Figure 1:
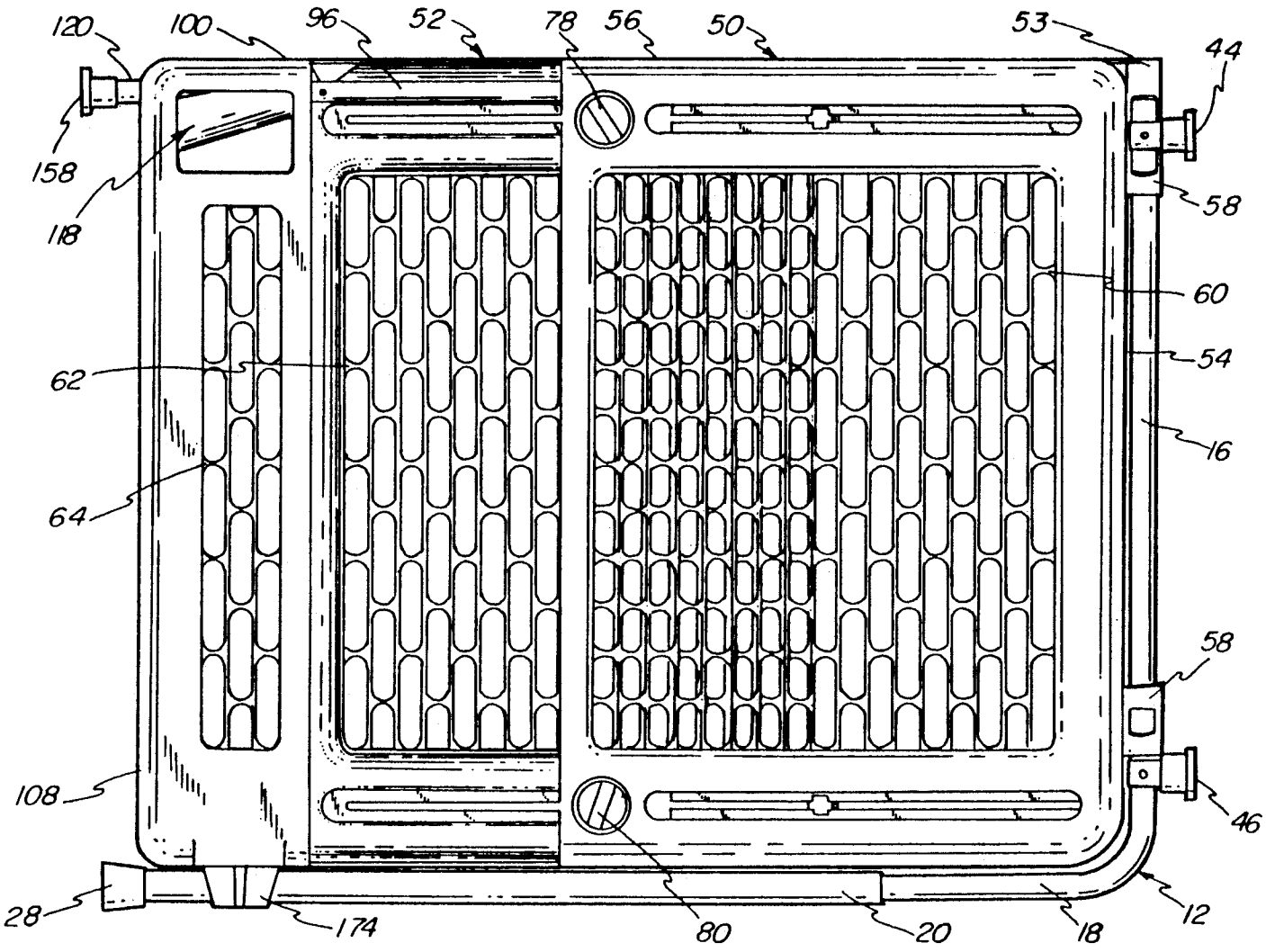
FIG. 1 is a front elevational view of the present invention.
Figure 2:
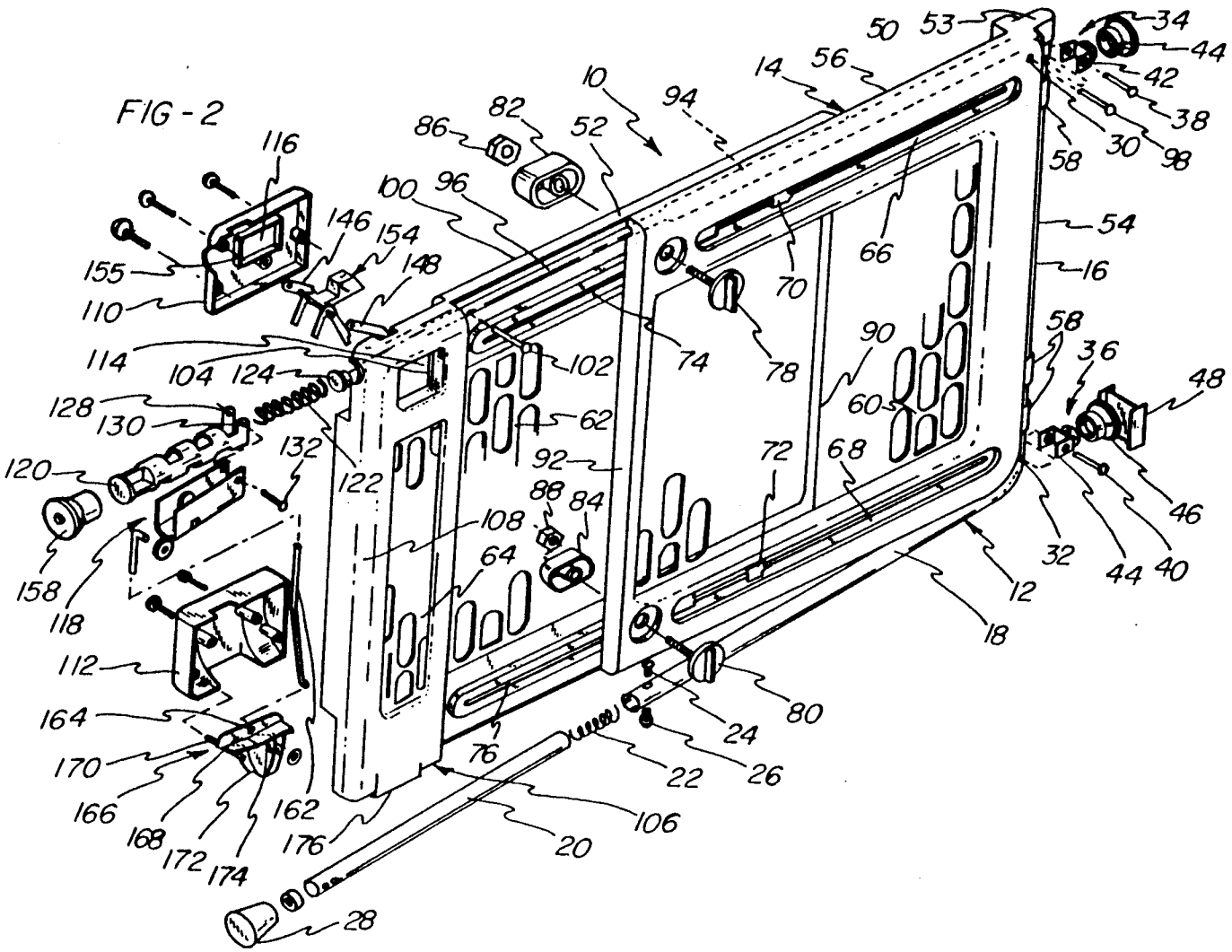
FIG. 2 is an exploded perspective view of the present invention.

As may be seen in FIGS. 1 and 2, the gate assembly 10 of the present invention includes a frame member 12 for positioning between opposing first and second substantially vertical doorway surfaces, and a panel portion 14 is supported by the frame member for pivotal movement relative to the frame member 12.

The frame member 12 is formed as a tubular member having a vertical portion 16 and a horizontal portion 18. The horizontal portion is oriented at approximately 95° relative to the vertical portion 16 to thereby form a generally L-shaped structure.

An extension tube 20 is provided for positioning over the horizontal portion 18 whereby the length of the horizontal portion may be varied. In order to provide a controlled variation in the length of the leg formed by the horizontal portion 18 and the extension tube 20, a coil spring 22 is provided having one end thereof immovably attached to the extension tube 20 at an interior location thereof. The remaining portion of the coil spring 22 extends beyond the end of the tube 20 and into the horizontal portion 18. A pair of diametrically opposed rivets 24, 26 extend through the wall of the horizontal portion 18 and define spring engaging lugs for engaging the coils of the spring 22.

Thus, as the extension tube 20 is rotated relative to the horizontal portion 18, the spring 22 will be advanced into or retracted out of the horizontal portion 18 to thereby vary the extension of the extension tube 20. In other words, the coil spring 22 is threadably engaged with the rivets 24, 26 and threaded adjustment between the tubular sections 18, 20 is effected by advancement of the coil spring 22 through the horizontal portion 18. Further details of this construction may be seen in U.S. Pat. No. 4,492,263, which patent is incorporated in pertinent part herein by reference.

The end of the extension tube 20 is provided with a conventional contact pad 28 for contacting one of the doorway surfaces. The contact pad 28 is preferably formed of a rubber-like substance such that significant frictional forces may be created between the pad 28 and the doorway surface.

The vertical portion 16 of the frame member 12 includes a pair of vertically spaced holes 30, 32 for mounting a pair of doorway engaging assemblies 34, 36 by means of pins 38, 40. The engaging assemblies include a pair of blocks 42, 44 which are mounted directly to the vertical frame portion 16. A pair of friction pads 44, 46 similar to the pad 28 are attached to the blocks 42, 44 for frictionally engaging a doorway surface opposite from the doorway surface engaged by the friction pad 28.

When the gate assembly 10 is mounted in a doorway, the extension tube 20 is rotated until the distance between the pad 28 and the opposite pads 44, 46 is greater than the distance between the opposing doorway surfaces. The extension tube 20 may then be pushed inwardly over the horizontal portion 18 to compress the spring 22 to allow the frame member 12 to be placed within the doorway such that upon release of the extension tube 20, the contact pads 28, 44 and 46 will engage the doorway surfaces to frictionally hold the frame member 12 in place. It should be noted that as a result of forming the frame member 12 with a 95° angle between the vertical portion 16 and the horizontal portion 18, the greatest frictional force will be applied at the pads 28 and 44 to firmly hold the frame in place.

It should also be noted that rail caps 48, one of which is shown adjacent to the lower doorway engaging assembly 34, may be provided for use with the contact pads 28, 44, 46. The rail caps 48 are designed for use in locations where only a narrow contact surface is available such as may be provided by wrought iron railing. When this is the case, one side of the rail caps 48 may be attached to the railing while the other side forms a contact base sufficiently broad to receive one of the contact pads.

The panel portion 14 is defined by first and second panel elements 50 and 52 which elements are mounted in sliding engagement with each other. The first panel element 50 defines a first vertical edge 54 of the panel portion 50 located adjacent to and substantially parallel to the vertical portion 16 of the frame member 12. A cap extension 53 extends laterally beyond the edge 54 of the first panel element 50 and is formed coextensively with an upper edge 56 thereof. The cap extension 53 includes a recess for receiving the upper end of the vertical portion 16 whereby the cap extension 53 acts to close off this end as well as form a support for carrying a portion of the weight of the panel portion 14. It should be noted that the cap extension 53 eliminates a pinch point which otherwise would exist between the first panel portion 50 and the vertical portion 16 if a separate member were provided for closing off the upper end of the vertical portion 16 such that a gap is formed between panel 50 and the frame 12.

The first panel element 50 further includes a plurality of hinge circles 58 extending laterally from the first edge 54 for engagement with the vertical portion 16. Each of the hinge circles 58 partially extends around the vertical portion 16 to form a hinge for supporting and guiding the panel portion 14 in pivotal movement about the frame members 12. It should be noted that the hinge circles 58 are located adjacent to the blocks 42 and 44 such that the hinge circles 58 cooperate with the hinge blocks 42, 44 to prevent vertical movement of the panel portion 14 relative to the frame member 12.

Each of the panel elements 50, 52 is provided with a grid area 60, 62, respectively surrounded by edge portions defining the peripheral edges of the panel elements 50, 52. In addition, the panel element 52 includes a further grid area 64 at a side of the panel portion 14 opposite from the hinge circles 58. The grid portions 60, 62, 64 provide a lightweight closure structure while also permitting children and pets to be able to see through the gate assembly 10.

The panel element 50 includes a pair of guide slots 66, 68 extending therethrough and including a pair of sliding guide members 70, 72 positioned within grooves formed in the slots 66, 68. Similarly, the second panel element 52 includes a pair of slots 74, 76 extending therethrough and including grooves therein on a side of the panel portion 14 opposite from the grooves formed in the slots 66, 68. The slots 74, 76 receive and retain a portion of the guide elements 70, 72 whereby the first and second panel elements 50, 52 are held together in sliding engagement with each other.

In addition, a pair of knobs 78, 80 extend through apertures 82, 84 formed in the first panel element 50 and include threaded shanks for extending into the slots 74, 76 of the second panel element 52. The threaded shanks of the knobs 78, 80 pass through nut blocks 82, 84 and threadably engage nuts 86, 88. Further, each of the nut blocks 82, 84 include a toothed surface for engaging a cooperating tooth surface formed in the grooves of the slots 74, 76 whereby tightening of the knobs 78, 80 will cause the two panel elements 50, 52 to be locked in position relative to each other.

It should be noted that the sliding guide elements 70, 72 are held in position adjacent to the edge 90 of the second panel portion 52 whereby the edge 90 is held in close proximity to the first panel portion 50. Similarly, the knobs 78, 80 are held in position adjacent to the edge 92 of the first panel portion 50 such that this edge is continuously held in close proximity to the second panel portion 52 as the two panel portions 50, 52 are slidably adjusted relative to each other.

The above-described guide elements for guiding the panel portions 50, 52 in sliding relation to each other are further described in U.S. Pat. No. 4,944,117, which patent is incorporated herein by reference.

The first and second panel elements 50, 52 are further provided with a telescoping tube assembly including an outer tube 94 and an inner tube 96 slidably received within the outer tube 94. The outer tube 94 is held immovably in position near the top edge 56 of the first panel element 50 by means of a rivet 98 extending therethrough. In like manner, the inner tube 96 is held in position adjacent to an upper edge 100 of the second panel element 52 by means of a rivet 102. The inner tube 96 extends beyond an intermediate panel edge 104 for purposes to be described further below.

The telescoping tubes 94, 96 contribute to the rigidity of the upper portion of the gate structure, as well as facilitating in guiding relative movement between the panel elements 50, 52.

The end portion of the second panel element 52 enclosing the grid portion 64 defines a latch section 106 for the gate assembly 10. The latch section 106 generally includes a main housing portion 108, an upper cover 110 and a lower cover 112 for attachment to the main body 108.

The upper portion of the latch section 106 is provided with a through slot 114 and the upper cover 110 includes a cooperating through slot 116. The slots 114, 116 form a hand hole of sufficient size to receive the hand of an adult whereby a lever 118 located therein may be operated to actuate a latch mechanism.

The inner tube 96 extends into at least a rearward upper corner of the hand hole formed by the slots 114 and 116 and a hollow spring cup 120 is positioned with a rearward end thereof extending in telescoping relationship over the end of the tube 96. A spring 122 is located within the spring cup 120 having a forward end thereof engaging an end wall of the hollow portion of the cup 120 and an opposite end thereof engaging a cap 124 positioned on the end of the inner tube 96. Thus, the spring cup 120 is biased by the spring 122 outwardly from a side wall 126 opposite from the side wall 54.

The spring cup 120 is provided with a pair of upwardly extending ears 128, 130, each of the ears 128, 130 having an aperture therethrough for receiving a pin 132. In addition, the lever 118 includes a pair of apertures 134 (see FIGS. 3 and 4) for receiving the pin 132 therethrough. Thus, the lever 118 may be positioned surrounding the spring cup 120 and with the apertures 134 aligned with the apertures in the ears 128, 130 such that the pin 132 may be positioned therethrough to connect the rear portion of the lever 118 to the rear portion of the spring cup 120.

Figure 3:
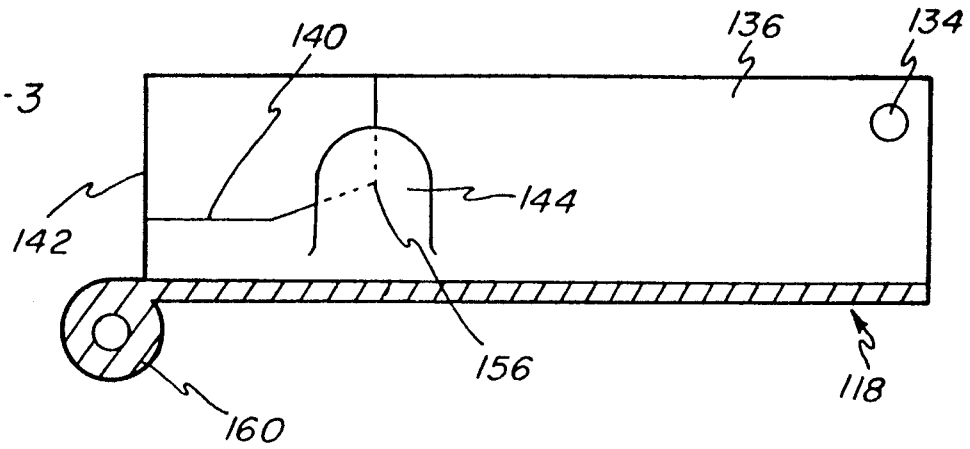
FIG. 3 is an elevational view taken along a longitudinal mid-section of the lever.
Figure 4:
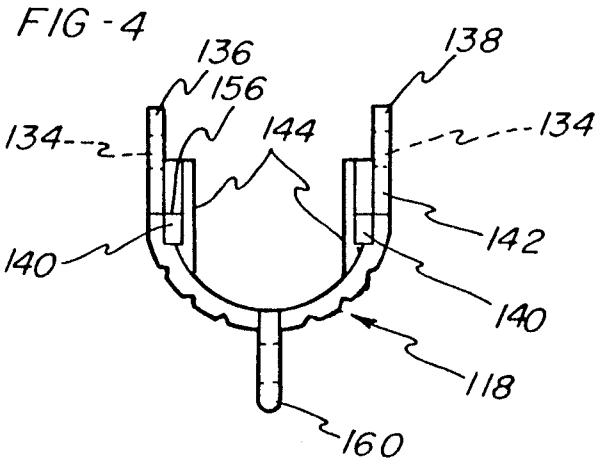
FIG. 4 is an elevational view from the front end of the lever.

Referring to FIGS. 3 and 4, the lever 118 is formed as a U-shaped member having opposing upwardly extending walls 136, 138. The interior surface of each of the walls 136, 138 is provided with a ledge portion 140 molded therein. The ledges 140 extend from a forward edge 142 of the lever 118 to a point behind inner guide walls 144.

Figure 5:
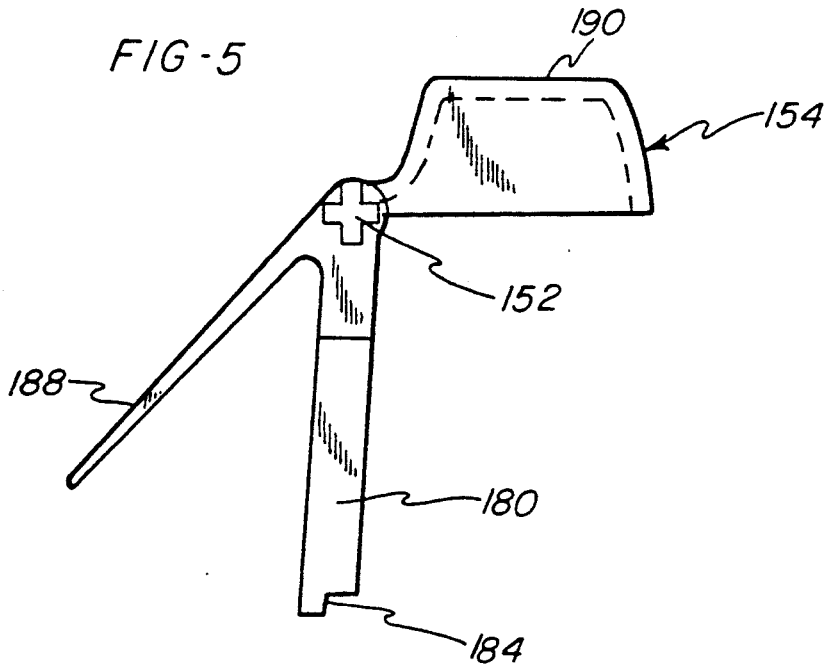
FIG. 5 is a side elevational view of the locking member.
Figure 6:
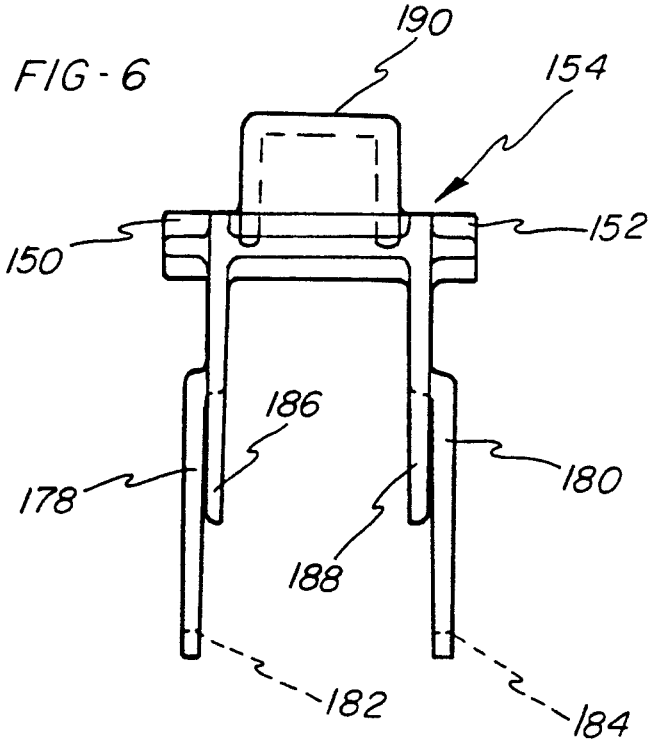
FIG. 6 is an elevational view of the locking member taken from the front end thereof.

A pair of links 146, 148 are mounted to opposing pivot studs 150, 152 located on a locking member 154 (see FIGS. 5 and 6). The studs 150, 152 engage within respective apertures 155 in the upper cover member 110 and the main latching body 108 to mount the locking member 154 for pivotal movement. In addition, the links 146, 148 are freely pivotable relative to the locking member studs 150, 152.

Figure 7:
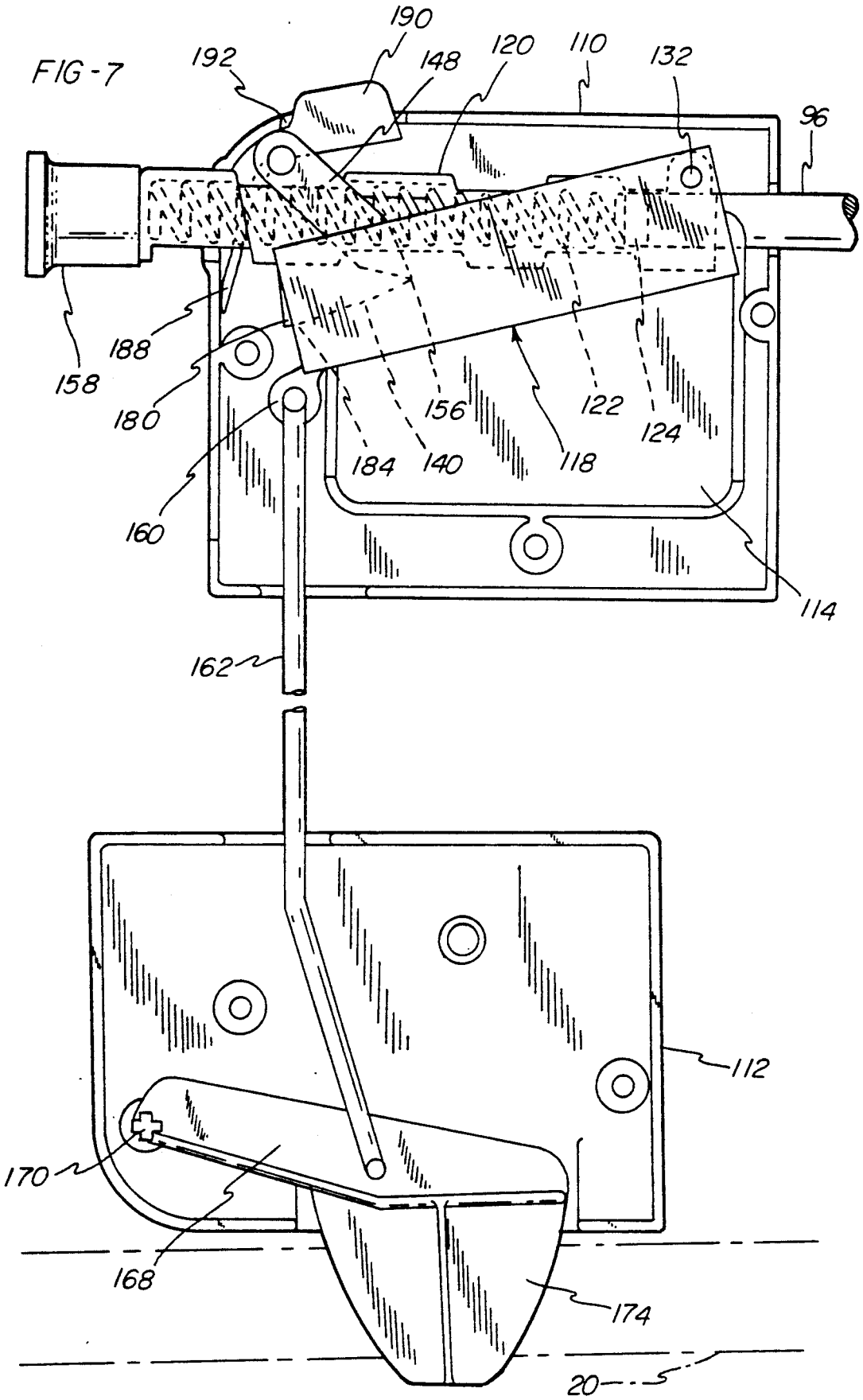
FIG. 7 is an elevational view of the mechanism for actuating the contact and latching members in position for locking the gate against pivotal movement.
Figure 8:
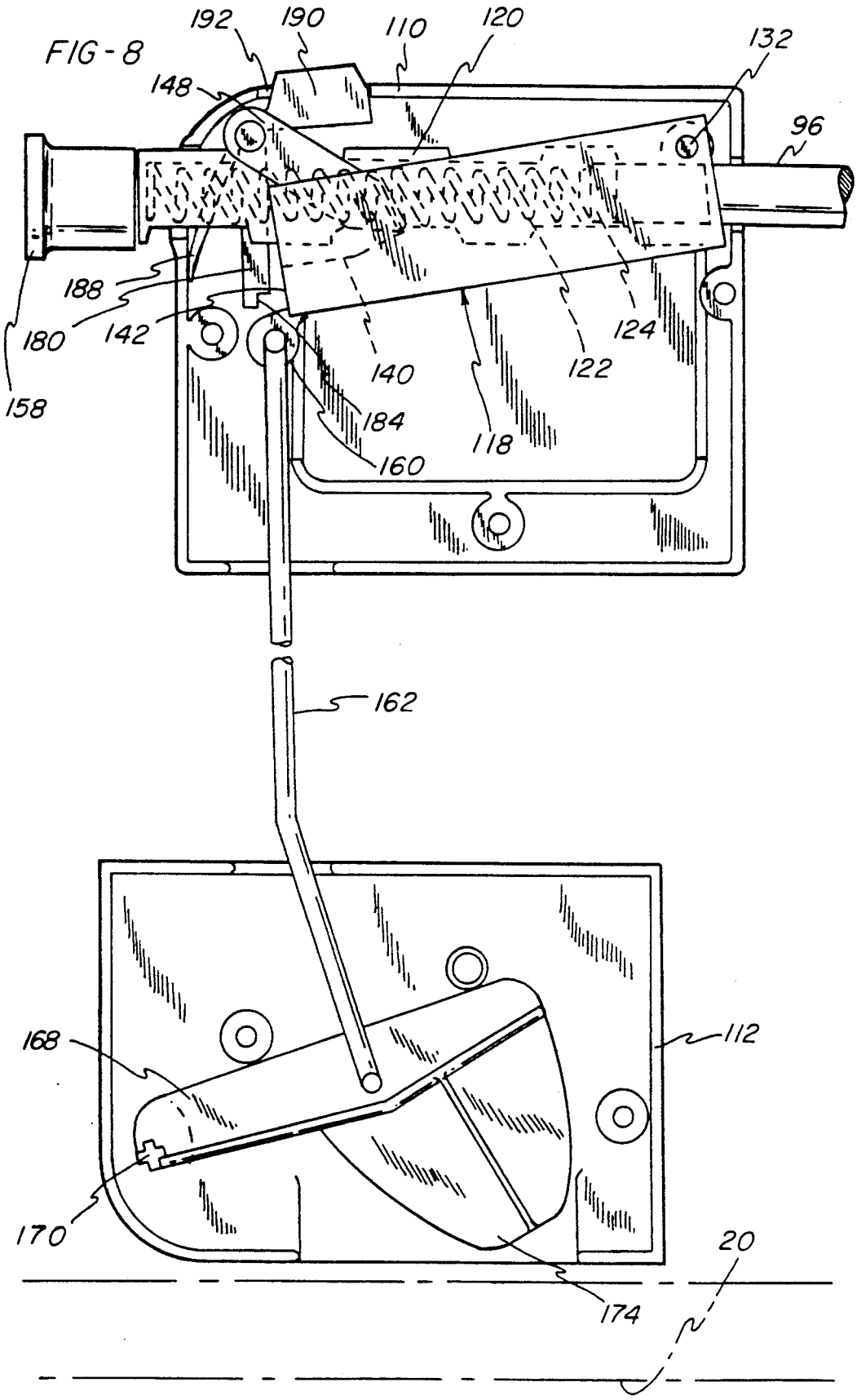
FIG. 8 is an elevational view showing the contact and latching members in position for permitting pivotal movement of the gate.

As may be seen in FIGS. 7 and 8, the links 146, 148 extend downwardly and rearwardly along the interior surface of the walls 136 and 138 of the lever 118 to engage the ledge portions 140 at pivot points 156 located within pockets defined by the ledge portions 140 and inner guide walls 144. Thus, the pockets act to retain the links 146, 148 in position contacting the pivot points 156.

It should be apparent that as the lever 118 is moved upwardly within the hand hole formed by the slots 114 and 116, the links 146, 148 will act to maintain the pivot points 156 at a constant distance from a predetermined stationary pivot point defined by the studs 150, 152. As the lever 118 is moved upwardly, the links 146, 148 will therefore act to push the lever 118 rearwardly and concurrently push the spring cup rearwardly over the inner tube 96 such that a contact pad 158 mounted to the end of the spring cup 120 may be moved back out of engagement with the wall surface engaged by the contact pad 28. Further, it should be noted that the spring 122 acts to bias the pivot points 156 into continuous contact with the ends of the links 146 and 148.

The lower front corner of the lever 118 is provided with a tab 160 having an aperture for receiving the end of a rod linkage 162. The rod 162 extends downwardly within the main body 108 adjacent to the front edge 126. The rod 162 includes a lower end which engages within an aperture 164 formed in latch 166. The latch 166 includes a forwardly extending pivot bar 168 mounting a pivot stud 170. The pivot stud engages apertures within the lower cover member 112 and within the main body 108 whereby the latch 166 is mounted for pivotal movement.

As seen in FIG. 2, the latch 166 includes a pair of latch legs 172, 174 extending downwardly in spaced relation to each other. The latch legs 172, 174 are spaced apart a sufficient distance to pass on either side of the extension tube 20. Thus, when the lever 118 is released such that the tab 160 moves downwardly to its lowest position, the rod 162 will move the latch 166 downwardly below the lower edge 176 of the panel portion 14 such that the legs 172, 174 engage on either side of the extension tube 20 (see FIG. 7) to thereby prevent pivotal movement of the panel portion 14 relative to the frame member 12. As shown in FIG. 8, when the lever 118 is pulled upwardly, the rod 162 transfers the upward movement to the latch 166 such that the latch 166 is pulled upwardly into the main body portion 108 to clear the legs 172, 174 of the extension tube 20 and the panel portion 14 will be free to pivot about its hinged connection with the frame member 12.

In addition, it should be noted that the rod 162 is bent rearwardly at a point adjacent to the upper surface of the lower cover 112 such that it engages the aperture 164 at a predetermined distance from the pivot point defined by the stud 170. By bending the rod 162 rearwardly the lever arm defined by the distance between the aperture 164 and the stud 170 is increased such that a given upward movement of the rod 162 results in a greater upward movement of the latch 166.

Referring to FIGS. 5 and 6, the locking member 154 is provided with a pair of stop legs 178, 180 having rearwardly facing notches 182, 184 formed in lower surfaces thereof. The notches 182, 184 are adapted to engage corners defined by the intersection of the ledge surfaces 140 with the front edge 142 of the lever 118 when the lever is located in its lowermost released position, as seen in FIG. 7.

The locking member 154 further includes a pair of spring legs 186, 188 formed integrally therewith for engaging an interior surface of the front edge 126 to thereby resiliently bias the stop legs 178, 180 rearwardly. With the notches 182, 184 engaged on the forward corners of the ledge surfaces 140, the lever 118 will be prevented from moving upwardly which in turn will prevent the panel portion 14 from being unlatched to pivot relative to the frame member 12.

A button 190 is provided rigidly connected to the stop legs 178, 180 and the button 190 is biased by the spring legs 186, 188 to extend upwardly through a slot 192 formed in the upper surface 100 of the second panel element 52. Thus, it should be apparent that the lever 118 may only be operated after the button 190 is depressed to move the notches 182, 184 out of engagement with the ledge surfaces 140 and that upon releasing the button 190, the locking legs 178, 180 will be biased rearwardly such that the notches 182 and 184 again engage the ledge surfaces 140 when the lever 118 is released and moves to a lowermost position.

Figure 9:
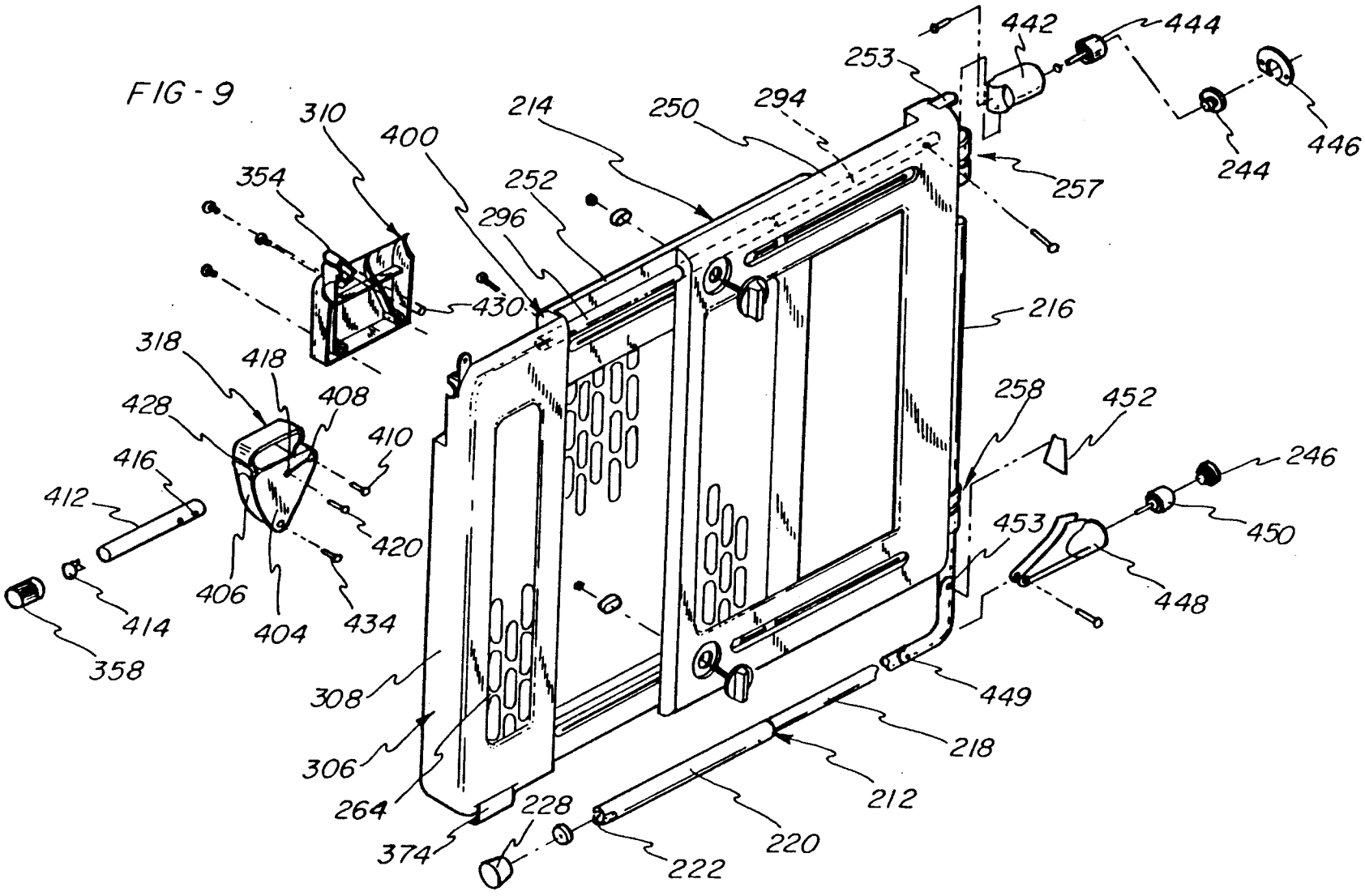
FIG. 9 is an exploded perspective view of the second embodiment of the present invention.

A second embodiment of the present invention is shown in FIGS. 9–16 in which elements substantially corresponding to elements in the first embodiment are labeled with the same reference numeral increased by 200. Referring to FIG. 9, the gate of the second embodiment includes a panel portion 214 formed of first and second panel elements 250, 252 which are slidably engaged with each other in the same manner as was described for the first embodiment.

The second panel element 252 is formed with a latch section 306 at an edge thereof distal from the edge engaging the first panel element 250. The latch section 306 generally includes a main housing portion 308 and an upper cover 310 for attachment to the main body 308. The upper edge of the main body 308 includes means defining a slot area 400 and a slot is defined in the area 400 when the cover 310 is fastened in place on the main body 308 for receiving a lever 318 therein.

Figure 10:
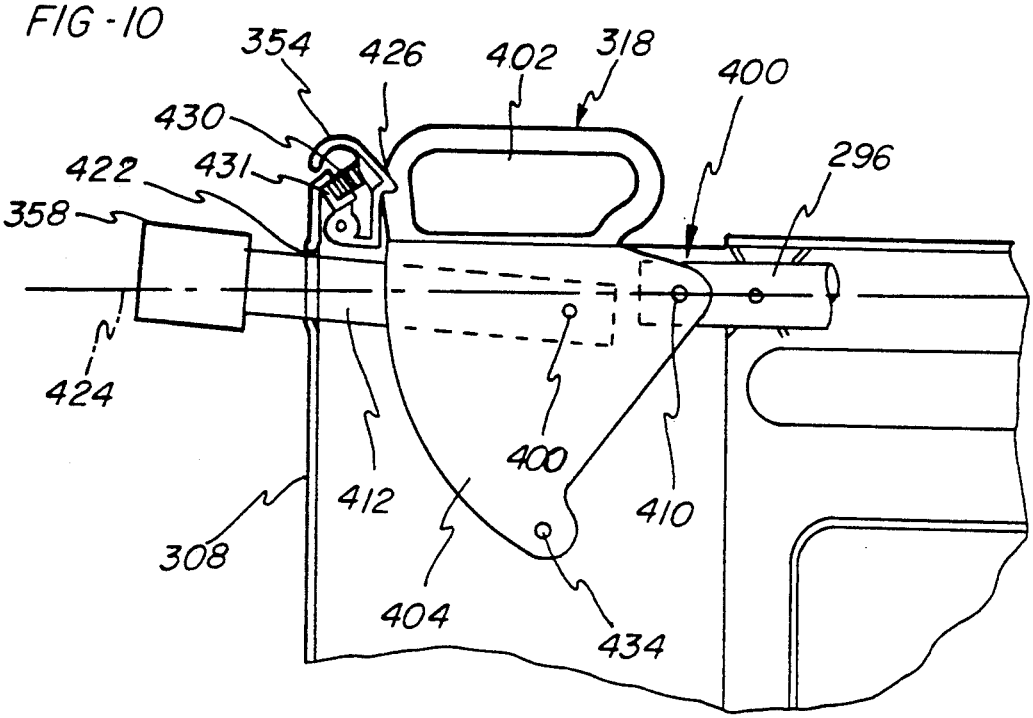
FIG. 10 is a cut-away side elevational view of the mechanism of the second embodiment for actuating the contact member wherein the mechanism is shown in position for locking the gate against pivotal movement.
Figure 11:
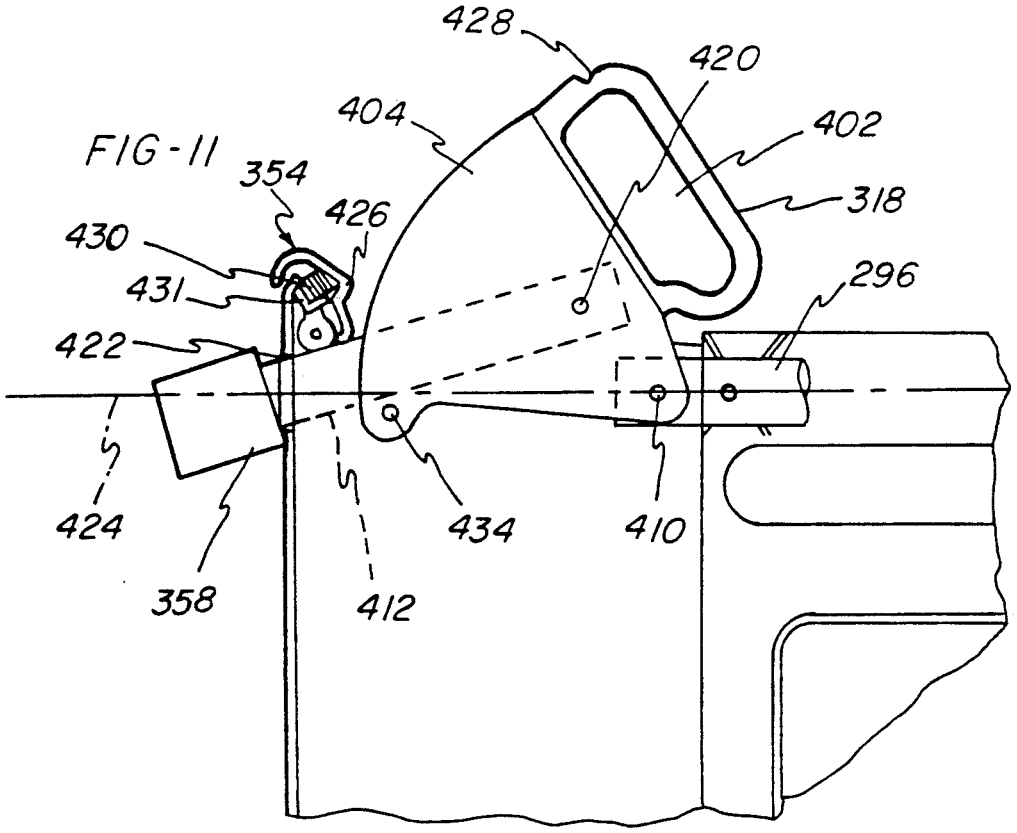
FIG. 11 is a view similar to FIG. 10 wherein the mechanism for actuating the contact member is shown in position for permitting pivotal movement of the gate.

Referring further to FIGS. 10 and 11, the lever 318 is formed with a hand receiving slot 402 for receiving an operator's hand to operate the lever 318. The lever 318 includes opposing downwardly extending walls 404, 406 and each of the walls 404, 406 is formed with an aperture 408. Thus, the lever 318 may be positioned with the walls 404, 406 straddling the inner tube 296 and a pin 410 may be positioned extending through the apertures 408 and the tube 296 to pivotally mount the lever 318 to the panel portion 214.

A contact member is provided including a tubular rod element 412, an end cap 414 for covering an end of rod 412 and a contact pad 358 which is positioned over member 414 and the end of rod of 412. The end of the rod 412 opposite from the contact pad 358 includes an aperture 416 which may be aligned with apertures 418 formed in the walls 404, 406 such that a pin element 420 may be extended through the walls 404, 406 and the rod 412 to mount the rod 412 for pivotal movement relative to the lever 318.

The main housing portion 308 includes means defining an aperture 422 in the front edge thereof and the rod 412 extends through and is supported by the aperture 422. Thus, the rod 412 may be moved into and out of the housing portion 308 to move the contact pad 358 toward and away from a wall surface as the lever 318 is pivoted into and out of the slot 400.

As may be seen in FIG. 10, the lever 318 has been pivoted into the slot 400 such that the rod 412 and contact pad 358 are in their fully extended positions for contacting a wall. In this position, it should be noted that the pivot point defined by the pin 420 is located below a line 424 passing through the pivot point at pin 410 and a center point through the aperture 422 such that the rod 412 and contact pad 358 are pointing slightly upwardly. This is an overcenter position of the mechanism in which any force against the contact pad 358 results in the pivot point 420 being biased downwardly to insure that the lever 318 remains in its desired position within the slot 400.

In addition, a locking member 354 is provided formed integrally with the cover 310 such that a resilient connection is provided to permit movement of the locking member 54 relative to the cover 310. The locking member includes a pawl portion 426 for engaging within a slot 428 formed in a forward wall of the lever 318. With the pawl portion 426 thus engaged in the slot 428, the lever 318 is prevented from moving upwardly out of the slot 400. In order to further insure positive engagement between the pawl portion 426 and the slot 428, a spring 430 is positioned between a stationary member 431 on the cover 310 and an inner surface of the locking member 354. Further, when the cover member 310 is located in place on the body portion 308, an upwardly extending tab 432 on the body portion 308 acts as a cover for the exposed side of the locking member 354 while permitting movement of the locking member 354 relative to the body portion.

Referring to FIG. 11, the locking member 354 is shown in its forwardmost position for releasing the lever 318 for upward movement, and the lever 318 is shown pivoted out of the slot 400. It may be seen that the pivot pin 420 holding the end of the rod 412 has moved in an arc about the pivot point defined by pin 410 to draw the rod 412 inwardly through the aperture 422 and move the contact pad 358 out of contact with a wall surface. With reference to FIG. 11, it should be further noted that an additional pin 434 is provided extending through the walls 404, 406 to form a stop member for engaging a lower surface of the rod 412 as the lever 318 is pivoted upwardly to thus limit the movement of the lever 318.

Referring to FIGS. 12–15, the latch portion 366 for engaging the horizontal tube 220 of the frame member 212 differs from the first embodiment in that a pair of clasp members 372, 374 are formed integrally with the lower edge of the main body portion 308. Each of the clasp members 372, 374 are formed with an enlarged edge portion 436, 438 for engaging the outer surface of the horizontal tube 220 to resist upward movement and disengagement of the panel portion 214 from the horizontal tube 220. However, when a sufficient upward force is applied to the panel portion 214, the clasp members 372, 374 will bend outwardly to permit the enlarged portions 436, 438 to pass around the horizontal tube 220.

Figure 13:
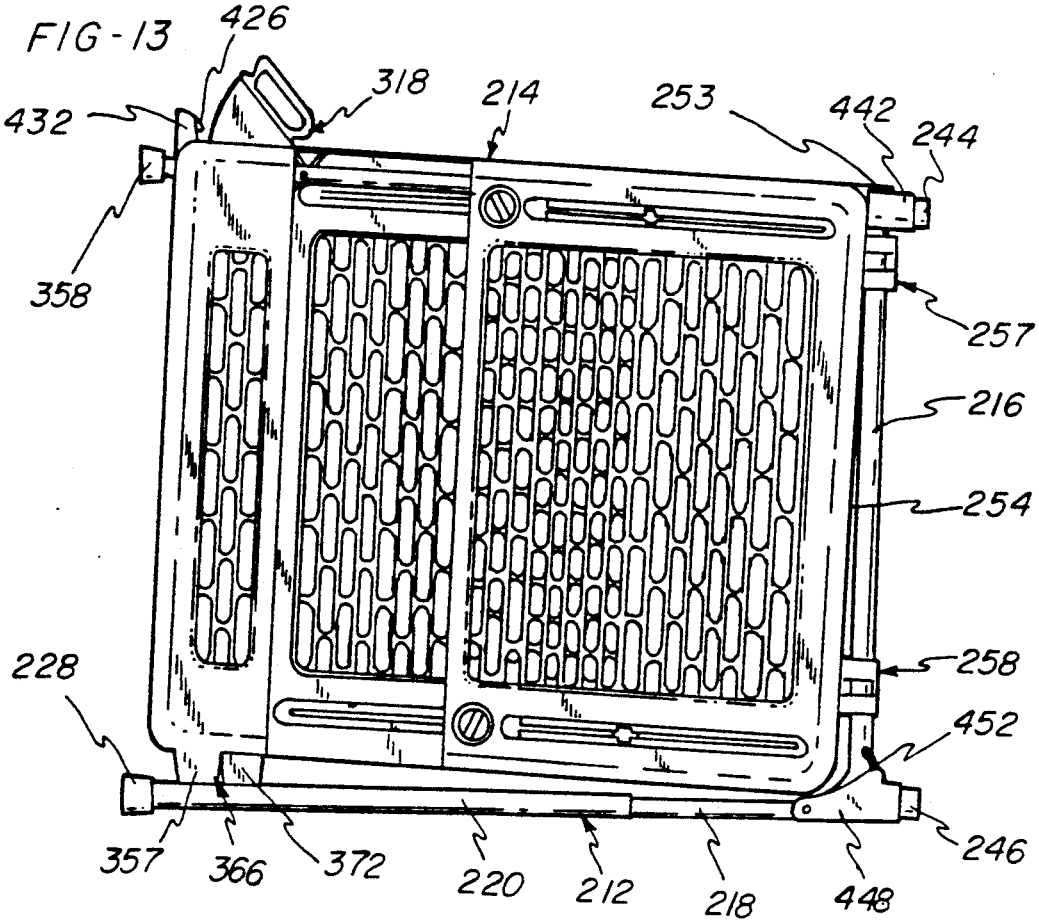
FIG. 13 is a front elevational view of the second embodiment showing the gate in position for pivotal movement.
Figure 14:
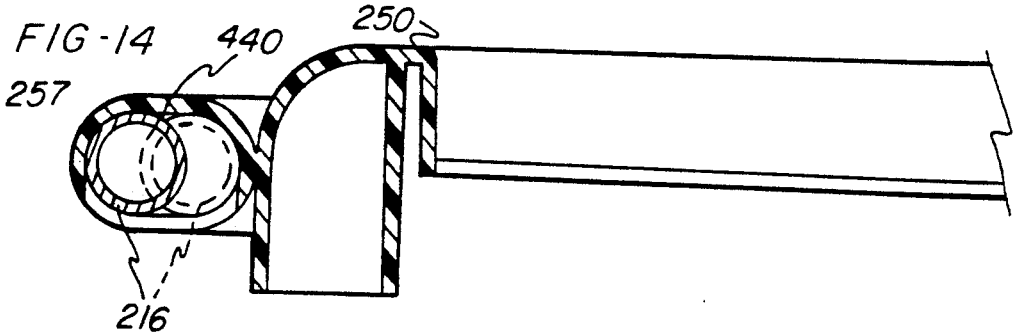
FIG. 14 is a cross-sectional view taken along line 14–14 in FIG. 12.
Figure 15:
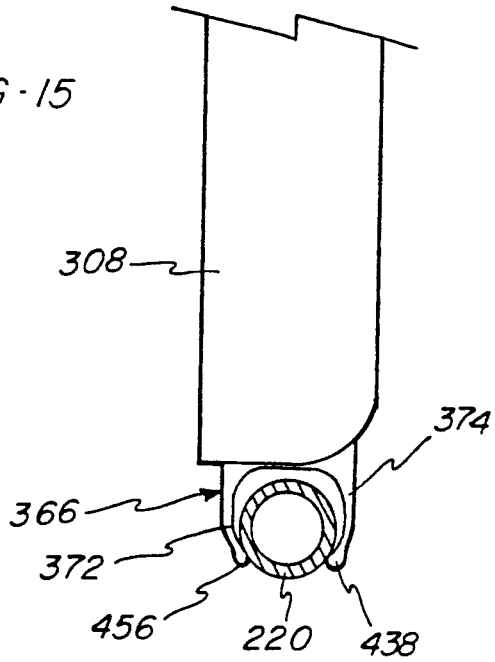
FIG. 15 is an elevational view taken from the second engagement side of the panel portion of the second embodiment and showing the clasp members.

In order to accommodate the movement of the panel portion 214 relative to the frame 212, the first panel element 250 is provided with upper and lower hinge elements 257, 258 which each define a substantially oval or oblong aperture 440 for receiving the vertical frame portion 216. As may be seen in FIG. 14, the vertical frame portion 216 may move horizontally within the aperture 440 defined by the hinge element 257. Thus, the upper edge of the panel portion 214 may be moved toward the vertical frame portion 216 while the lower edge of the panel portion 214 may be moved away from the vertical frame portion 216 to pivot the panel portion 214 with its lower edge oriented at an acute angle relative to the horizontal frame tube 220, as is illustrated in FIG. 13. The apertures in the hinge elements 257, 258 are dimensioned such that the acute angle formed by the panel portion will be approximately 5° to 7° relative to the horizontal frame tube 220. This angle is sufficient to cause the clasp elements 372, 374 to clear the horizontal frame tube 220 to permit pivotal movement of the panel portion 214 relative to the frame member 216.

Figure 12:
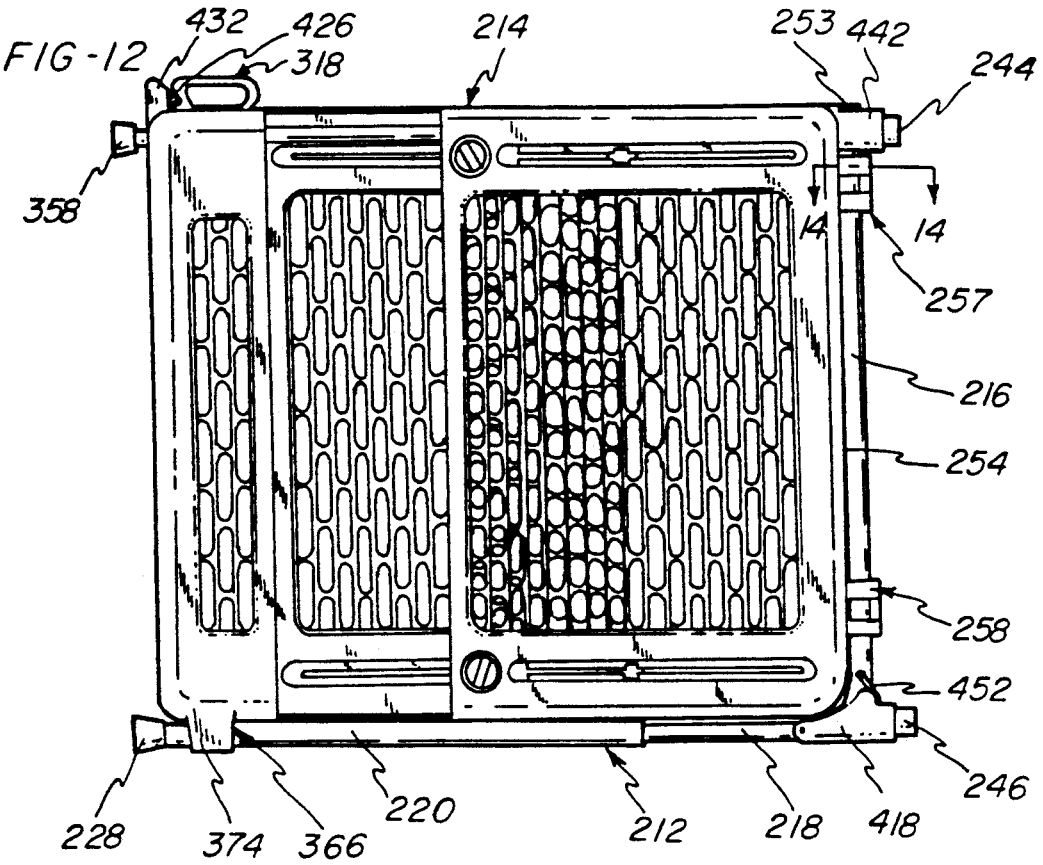
FIG. 12 is a front elevational view of the second embodiment showing the gate in a locked position.

When the panel portion 214 is locked in place relative to the frame member 212, as shown in FIG. 12, the contact pad 358 will contact a doorway surface and bias the panel edge 254 toward the vertical frame portion 216 such that the hinge elements 257, 258 will be prevented from moving relative to the vertical frame portion 216. In addition, it should be noted that a hinge fitting 442 is rigidly attached to the upper end of the vertical frame portion 216 to limit upward movement of the hinge 257 relative to the frame portion 216 and that the panel element 250 is formed with a tab 253 extending over the hinge fitting 442 to thereby limit downward movement of the panel portion 214.

A contact pad mount 444 and contact pad 244 are attached to the hinge fitting 442 for contacting a wall surface opposite from the contact pad 358. Further, it should be noted that a C-stop assembly 446 may be provided for attaching to a doorway wall surface for receiving the contact pad 244 and thereby positively limiting movement of the vertical frame portion 216.

Figure 16:
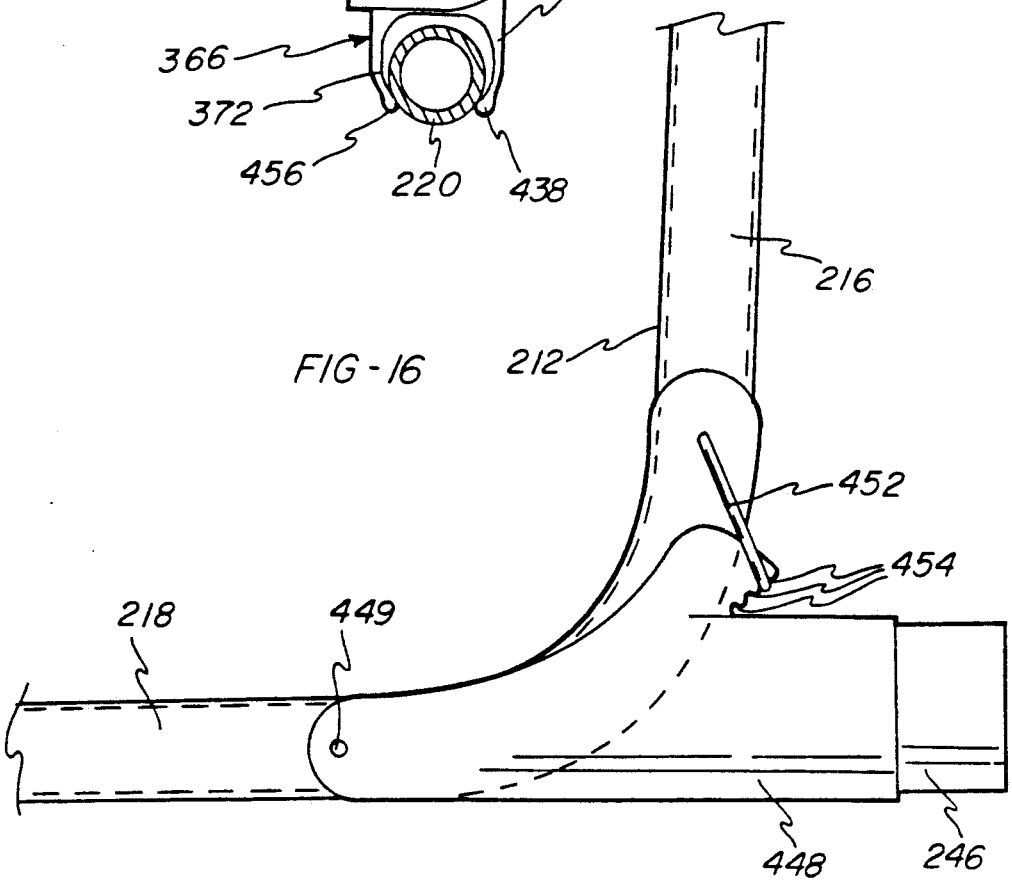
FIG. 16 is an enlarged elevational view showing the pivoted foot member of the first engagement means for the second embodiment.

As may be seen in FIG. 16, a foot member 448 is provided at the junction between the vertical frame portion 216 and the horizontal frame portion 218 wherein the foot member 448 is pivotally mounted to the horizontal frame portion 218 at a pivot point 449. The foot member 448 carries a contact pad mount 450 and contact pad 246 for engaging a wall surface opposite from the contact pad 228.

A wire bail member 452 is mounted for pivotal movement within an aperture 453 in the vertical frame portion 216. The bail member 252 is formed as a loop for engaging in one of a plurality of recesses 454 formed in an upper surface of the foot member 448. Thus, the bail member 452 acts as a pawl for engaging a recess 454 to limit downward movement of the foot member 448 relative to the frame 212.

The pivotal foot member 448 facilitates mounting of the frame 212 within a doorway to insure that the opposing contact pads 228 and 246 are firmly engaged with respective doorway surfaces. During mounting of the frame 212 within a doorway, the foot member 448 is initially in a downwardly pivoted position with the contact pad 246 adjacent to a corner formed between adjoining floor and doorway surfaces. The horizontal frame portion 218 is preferably angled downwardly and the tube 220 has been adjusted outwardly, as described in the previous embodiment, such that the contact pad 228 is located adjacent to a corner formed by a respective doorway surface and a floor surface. With the contact pads 228 and 246 thus positioned, the frame member 212 is moved downwardly to a position with the horizontal portion 218 parallel to the floor surface to thereby compress the spring 222 as the foot member 448 pivots around and pushes the frame portion 218 into the tube 220. The bail member 452 is then pivoted into association with one of the recesses 454 to thereby lock the foot member 448 in position relative to the frame 212 to prevent the frame 212 from lifting upwardly relative to the foot member 448.

The above-described mechanism for mounting the frame 212 within a doorway provides firm engagement between the contact pads 228, 246 and their respective doorway surfaces whereby vertical movement of the frame member 212 during the lifting and pivotal movement of the panel portion 214 is prevented.

From the above description, it should be apparent that the present invention provides a gate for use as a closure device in a doorway wherein the distance between the opposing sides of the gate may be adjusted to accommodate different sizes of doorways. In the particular embodiments contemplated, the gate may be used in doorways ranging in width from approximately 27 inches to approximately 39 inches.

Further, an L-shaped frame member is provided for mounting the gate within the doorway including a spring biased extension portion which is adjustable independently from the adjustment of the panel portion of the gate such that the frame member may be adjusted within the doorway to obtain a preferred level of frictional force for holding the frame member in place, and wherein two immovable contact points are provided on one side of the doorway and a single immovable contact point is provided on an opposite doorway surface.

The gate of the present invention is further distinguished by providing a pivotal panel portion which may pivot either forwardly or rearwardly relative to the horizontal leg of the frame member which when engaged with a doorway surface forms a fourth contact point for maintaining the gate in position to resist forces applied to either face of the panel portion and thereby further prevent movement of the gate relative to the doorway.

Another unique feature of the present invention is the provision of a latching mechanism along a lower edge of the panel portion for engaging the horizontal tube of the frame member and thereby adding additional rigidity to the structure as it prevents relative movement between the lower edge of the panel portion and the frame member.

In addition, the release mechanism for releasing the upper contact point and the lower latching point to permit the panel to pivot relative to the frame is also a unique feature of the present invention in that it prevents a toddler from accidentally releasing the gate to open. Specifically, in the preferred use of the invention, a person operating the gate must first engage and press on the button and simultaneously pull upwardly on the lever to release the panel portion for pivotal movement. Thus, the release mechanism requires operation of two separate actuation means to release the panel portion from its stationary position relative to the frame. Further, it should be noted that after being released from the frame, the panel portion may pivot either forwardly or rearwardly relative to the horizontal member of the frame.

While the forms of apparatus herein described constitute preferred embodiments of the invention, it is to be understood that the invention is not limited to these precise forms of apparatus, and that changes may be made therein without departing from the scope of the invention which is defined in the appended claims.

What is claimed is:

1. A closure device for use in a doorway defined by opposing first and second doorway surfaces, said closure device comprising:

a frame member adapted to be positioned within said doorway and defining a frame member closure area, a panel portion positioned within said frame member closure area, hinge means mounting said panel portion to said frame member for pivotal movement, first engagement means attached to said frame member for engaging said first doorway surface, second engagement means attached to said frame member for engaging said second doorway surface to thereby cooperate with said first engagement means to hold said frame member in a predetermined position within said doorway, a contact member supported by said panel portion for engaging said second doorway surface in a first position of said contact member and said contact member being movable relative to said panel portion to a second position out of contact with said second doorway surface, a lever mounted for movement relative to said panel portion, and connection means defining a pivotal connection between said contact member and said lever such that movement of said lever causes said contact member to move between said first and second positions.

2. The device of claim 1, including means defining an aperture in said panel portion wherein said contact member passes through said aperture and said contact member pivots relative to said panel portion at said aperture as said contact member moves between said first and second positions.

3. The device of claim 1, including a lever pivot connection for mounting said lever for pivotal movement relative to said panel.

4. The device of claim 3, wherein said connection means moves about said lever pivot connection in an arc during said movement of said contact member between said first and second positions.

5. The device of claim 4, wherein said contact member includes a shaft and said panel portion includes means defining an aperture through which said shaft passes, said lever pivot connection and a center point of said aperture defining a center line wherein said connection means passes through said center line as said contact member moves between said first and second positions.

6. The device of claim 3, including a stop member located on said lever for engaging said contact member during pivotal movement of said lever such that engagement between said stop member and said contact member limits movement of said lever.

7. The device of claim 1, including a locking member for preventing movement of said contact member from said first to said second position.

8. The device of claim 7, wherein said lever includes means defining a slot and said locking member comprises a resilient pawl for engaging in said slot in response to movement of said lever causing said contact member to move into said first position.

9. The device of claim 1, including latch means mounted on said panel portion for engagement with said frame member adjacent to said second engagement means whereby pivotal movement of said panel portion about a vertical axis relative to said frame member is prevented.

10. The device of claim 9, wherein said panel portion is movable relative to said frame in a vertical direction to release said latch means from engagement with said frame member.

11. The device of claim 9, wherein said frame member includes a horizontal extension and said latch means comprises a pair of spaced clasp members extending from a lower edge of said panel portion for engaging said frame member on opposing sides of said horizontal extension.

12. A closure device for use in a doorway defined by opposing first and second doorway surfaces, said closure device comprising:

a frame member including a vertical portion and a horizontal portion, a panel portion including at least a vertical edge and a horizontal edge extending substantially parallel to said vertical portion and said horizontal portion, respectively, hinge means for mounting said panel portion to said frame member for pivotal movement whereby said panel portion may pivot relative to said horizontal portion, first engagement means attached to said frame member for engaging said first doorway surface, second engagement means attached to said frame member for engaging said second doorway surface to thereby cooperate with said first engagement means to hold said frame member in a predetermined position within said doorway, and latch means mounted to said panel portion for engaging said horizontal portion of said frame member to prevent relative movement between said panel portion and said frame member, said panel portion being movable in a vertical direction to move said latch means out of engagement with said horizontal portion to permit relative pivotal movement between said panel portion and said frame member.

13. The device of claim 12, wherein said latch means comprises a pair of spaced clasp members extending from said horizontal edge of said panel portion, said clasp members engaging said frame member on opposing sides of said horizontal portion.

14. The device of claim 12, wherein said hinge means permit horizontal movement of said panel portion relative to said vertical portion of said frame member.

15. The device of claim 12, wherein said hinge means includes means defining upper and lower substantially oval apertures receiving said vertical portion of said frame member, said apertures permitting said horizontal edge of said panel portion to angle upwardly whereby said latch means is moved out of engagement with said horizontal portion of said frame member.

16. The device of claim 12, wherein said first engagement means includes a foot member for engaging said first doorway surface and pivot means attaching said foot member to said frame member for pivotal movement of said foot member relative to said frame member.

17. The device of claim 16, wherein said foot member includes an upper surface defining a plurality of recesses and said first engagement means further includes a pawl member pivotally mounted to said vertical portion, said pawl member engaging one of said plurality of recesses to limit pivotal movement of said foot member.

18. The device of claim 12, including a contact member supported by said panel portion for engaging said second doorway surface in a first position of said contact member and said contact member being movable relative to said panel portion to a second position out of contact with said second doorway surface.

19. The device of claim 18, including a lever pivotally mounted to said panel portion, said lever being pivotally connected to said contact member at a pivot connection such that upward pivotal movement of said lever causes said contact member to pivot relative to said panel portion and move from said first to said second position.

20. A closure device for use in a doorway defined by opposing first and second doorway surfaces, said closure device comprising:

a frame member adapted to be positioned within said doorway, said frame member including a vertical portion and a horizontal portion to form an L-shaped structure defining a frame member closure area, a panel portion positioned within said frame member closure area, said panel portion including a horizontal edge adjacent to said horizontal portion of said frame member, hinge means formed on said panel portion for mounting said panel portion to said frame member for pivotal movement, said hinge means including means defining upper and lower substantially oval apertures receiving said vertical portion of said frame member whereby said vertical portion is movable within said apertures in a horizontal direction, first engagement means attached to said vertical portion of said frame member for engaging said first doorway surface, second engagement means attached to said horizontal portion of said frame member for engaging said second doorway surface to thereby cooperate with said first engagement means to hold said frame member in a predetermined position within said doorway, a contact member supported by said panel portion for engaging said second doorway surface in a first position of said contact member, said contact member being movable relative to said panel portion to a second position out of contact with said second doorway surface, a lever mounted to said panel portion at a pivot point such that said lever is pivotally movable relative to said panel portion, said lever including a hand aperture for receiving an operator's hand and means defining a slot, connection means defining a pivotal connection between said contact member and said lever such that movement of said lever causes said contact member to pivot relative to said panel portion and said lever and to move between said first and second positions, a pawl member mounted to said panel portion and resiliently biased toward said lever, said pawl member engaging said slot in said lever to lock said contact member in said first position, and latch means mounted to said panel portion for engaging said horizontal portion to prevent relative movement between said panel portion and said frame member, said panel portion being movable to position said horizontal edge at an acute angle relative to said horizontal portion of said frame member whereby said latch means is moved upwardly out of engagement with said horizontal portion to permit relative movement between said panel portion and said frame member.

21. A closure device for use in a doorway defined by opposing first and second doorway surfaces, said closure device comprising:

a frame member adapted to be positioned within said doorway and defining a frame member closure area, a panel portion positioned within said frame member closure area, hinge means mounting said panel portion to said frame member for pivotal movement, first engagement means attached to said frame member for engaging said first doorway surface, second engagement means attached to said frame member for engaging said second doorway surface to thereby cooperate with said first engagement means to hold said frame member in a predetermined position within said doorway, a contact member supported by and pivotally movable with said panel portion for engaging said second doorway surface, and resilient means acting between said first engagement means and said second engagement means for biasing said first and second engagement means apart and into frictional contact with said first and second doorway surfaces.

22. The device of claim 21, wherein said frame member includes a vertical portion and a horizontal portion to form a substantially L-shaped structure defining said frame member closure area.

23. The device of claim 22, including latch means extending from a lower edge of said panel portion for engaging said horizontal portion of said frame member to prevent relative movement between said panel portion and said frame member.

24. The device of claim 21, wherein said contact member is movable relative to said panel portion between a first position in contact with said second doorway surface and a second position out of contact with said second doorway surface.

* * * * *